US006094829A

United States Patent [19]

Koestler, III

[11] Patent Number: 6,094,829

[45] Date of Patent: Aug. 1, 2000

[54] LASER SIGHT FOR HUNTING BOW

[76] Inventor: Leo Vick Koestler, III, 119 Laura Lake Rd., Vicksburg, Miss. 39180

[21] Appl. No.: 09/195,316

[22] Filed: Nov. 18, 1998

[51] Int. Cl.[7] ..... F41G 1/467

[52] U.S. Cl. ..... 33/265; 33/DIG. 21; 124/87

[58] Field of Search ..... 33/241, 265, DIG. 21; 124/87

[56] References Cited

U.S. PATENT DOCUMENTS

| | | | |
|---|---|---|---|
| 3,477,130 | 11/1969 | Egan | 33/265 |
| 4,120,096 | 10/1978 | Keller | 33/265 |
| 4,368,581 | 1/1983 | Tullos | 33/265 |
| 4,535,544 | 8/1985 | Jones, et al. | 33/265 |
| 5,305,530 | 4/1994 | Robertson, Jr. et al. | 33/265 |
| 5,388,336 | 2/1995 | Pomaville | 33/241 |
| 5,419,050 | 5/1995 | Moore | 33/241 |
| 5,495,675 | 3/1996 | Huang | 124/87 |
| 5,651,185 | 7/1997 | Vanderheyden et al. | 124/87 |
| 5,782,002 | 7/1998 | Reed | 124/87 |
| 5,920,996 | 7/1999 | Hurckman et al. | 33/265 |

OTHER PUBLICATIONS

*Beamshot is Better*, Nov. 1998.

*Primary Examiner*—G. Bradley Bennett
*Attorney, Agent, or Firm*—John V. Stewart

[57] ABSTRACT

A laser sight with automatic angle compensation for bow hunting from tree platforms, comprising a box with open front and back ends attached to a bow handle. A laser pointer is pivotally mounted in the sight box. A cam operated by a pendulum moves the laser pointer to compensate the laser beam direction for different shot distances by detecting the vertical angle of the bow. The higher the bow is aimed, the lower the laser beam is aimed relative to the bow to compensate for the greater drop of the arrow over greater distance. A second pendulum in the sight box operates a peep pin for use with a conventional peep sight on the bowstring. The peep pin maintains an angle via its pendulum that guides the archer's line of sight to the laser spot, allowing the archer to visually acquire the spot quickly even during daylight. The laser beam and peep pin are coordinated via adjustments that are independent of each other and independent of cam or pendulums.

7 Claims, 8 Drawing Sheets

LASER SIGHT FOR HUNTING BOW

BACKGROUND OF THE INVENTION

1. Field of the Invention

This invention is in the field of sights for hunting bows, especially laser sights.

2. Description of Prior Art

Laser sights are available for hunting bows, as shown in the prior patent discussed below. However, they lack features provided by the present invention. Simple laser pointers with beam direction adjustments are available, but each setting only applies to a specific target distance and angle of the bow. The curvature of an arrow's trajectory depends on the vertical angle of the shot—the higher the shot, the greater its curvature. Bow hunters commonly shoot from platforms about 3–9 m (10–30 ft) high in trees. From this position, the angle of a shot is normally about 20–60 degrees downward from horizontal. The bow angle and distance to a target are closely related, especially on flat terrain. Thus a bow sight can theoretically compensate for changes in the distance based on the angle of the bow, as detected by a pendulum.

U.S. Pat. No. 5,782,002 (Reed) discloses a "Laser Guidance Means", comprising a pivotally mounted laser pointer 46 that rests on an offset cylindrical cam 52. The cam is mounted on a pendulum 60. The cam is attached to the pendulum by a screw 54 that moves the cam vertically for vertical adjustment of the laser beam. However, any vertical adjustment also changes the eccentricity of the cam from its pivot point 66. This dependency is undesirable. In Reed's patent drawings, the cam is offset upward from the pivot point 66, so its apex is the top of the cam. This is counterproductive. When the bow is aimed horizontally as in FIG. 5, Reed's laser will be aimed highest relative to the bow, but the arrow will fall lowest due to the longer flight distance and maximum gravity effect on the trajectory. Thus the setting shown in Reed will compensate in the opposite direction to what is needed, making it less accurate than a fixed laser pointer. Reed's cam can be moved lower, so that its geometric center is below the pendulum pivot axis. Then it will compensate in the right direction, but the magnitude and rate of compensation is dependent on the vertical setting. For example, when the required vertical setting places the geometric center of the cam coincident with the pendulum pivot axis, the cam eccentricity is zero, eliminating compensation entirely. There is no way in Reed to maintain a correct cam offset independently of the vertical setting.

In daylight a laser spot is hard to find when sighting. It is only a small dim spot distantly reflected by the camouflage colors of nature among dapples of sunlight. In a pendulum-compensated sight, the laser spot is not along a fixed line, so a simple mechanical peep sight is not sufficient to find it. Thus a peep sight that follows the moving laser spot is needed.

SUMMARY OF THE INVENTION

The objectives of the present invention are the provision of a laser sight for bows that automatically compensates for the angle of the bow via a pendulum-operated cam, that has a mechanical sight that follows the laser spot for visually acquiring the laser spot in daylight, and that has laser aim adjustments that are independent of the cam and the mechanical sight adjustments.

These objectives are achieved in the present laser sight using a laser pointer in a case with aim adjustment screws.

The laser pointer is pivotally mounted in a sight box having open front and back ends. A cam operated by a pendulum moves the laser pointer to compensate for changing shot distances by detecting the vertical angle of the bow. The higher the bow is aimed, the lower the laser beam is aimed relative to the bow, to compensate for the greater drop of the arrow over a greater target distance. A second pendulum in the sight box operates a peep pin for use with a conventional peep sight on the bowstring. The peep pin maintains an angle via its pendulum that guides the archer's line of sight to the laser spot, allowing the archer to find the spot quickly even during daylight.

REFERENCE NUMERALS

Figure 1:
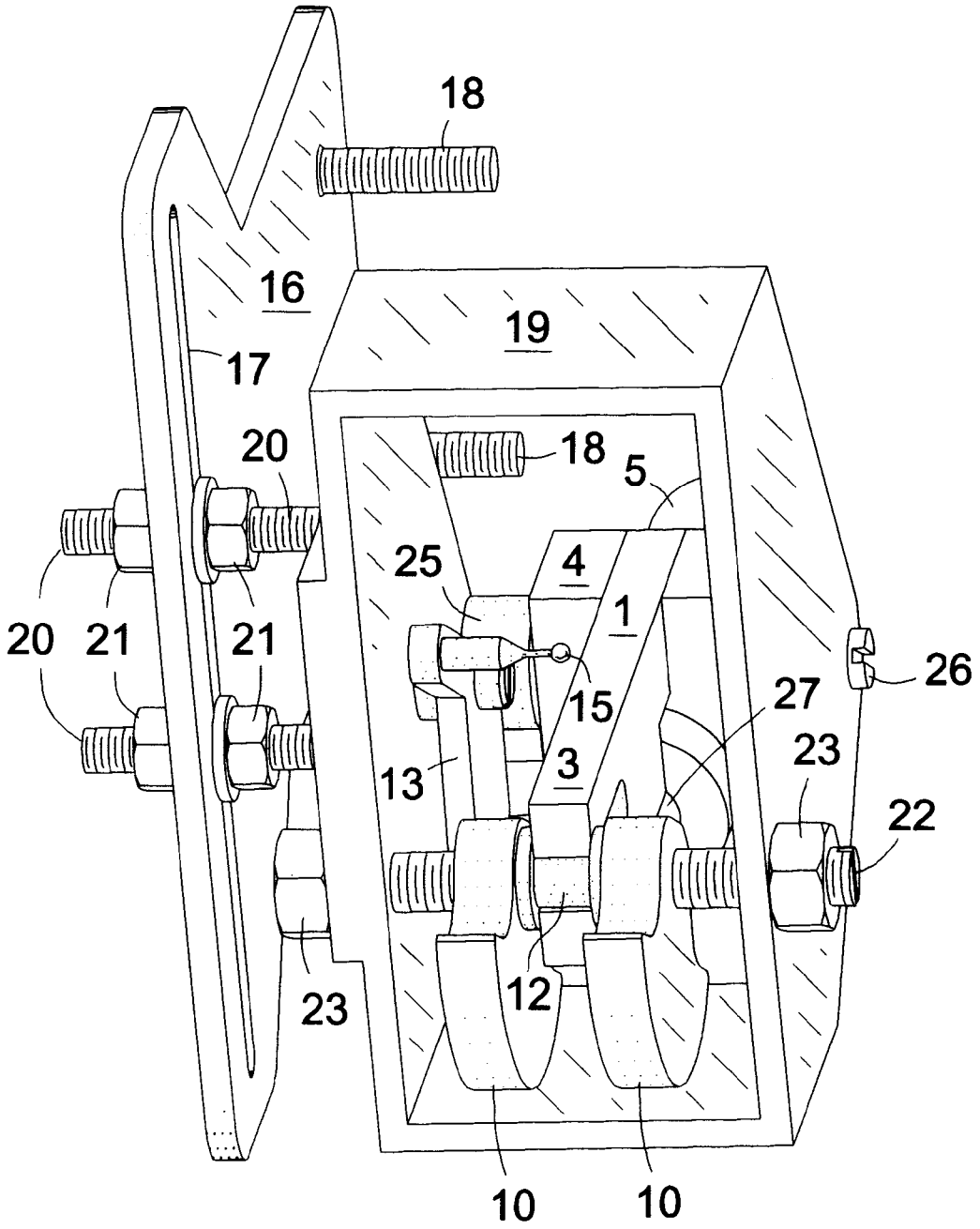
FIG. 1 is a frontal perspective view of the laser sight aimed 30 degrees below horizontal.
Figure 2:
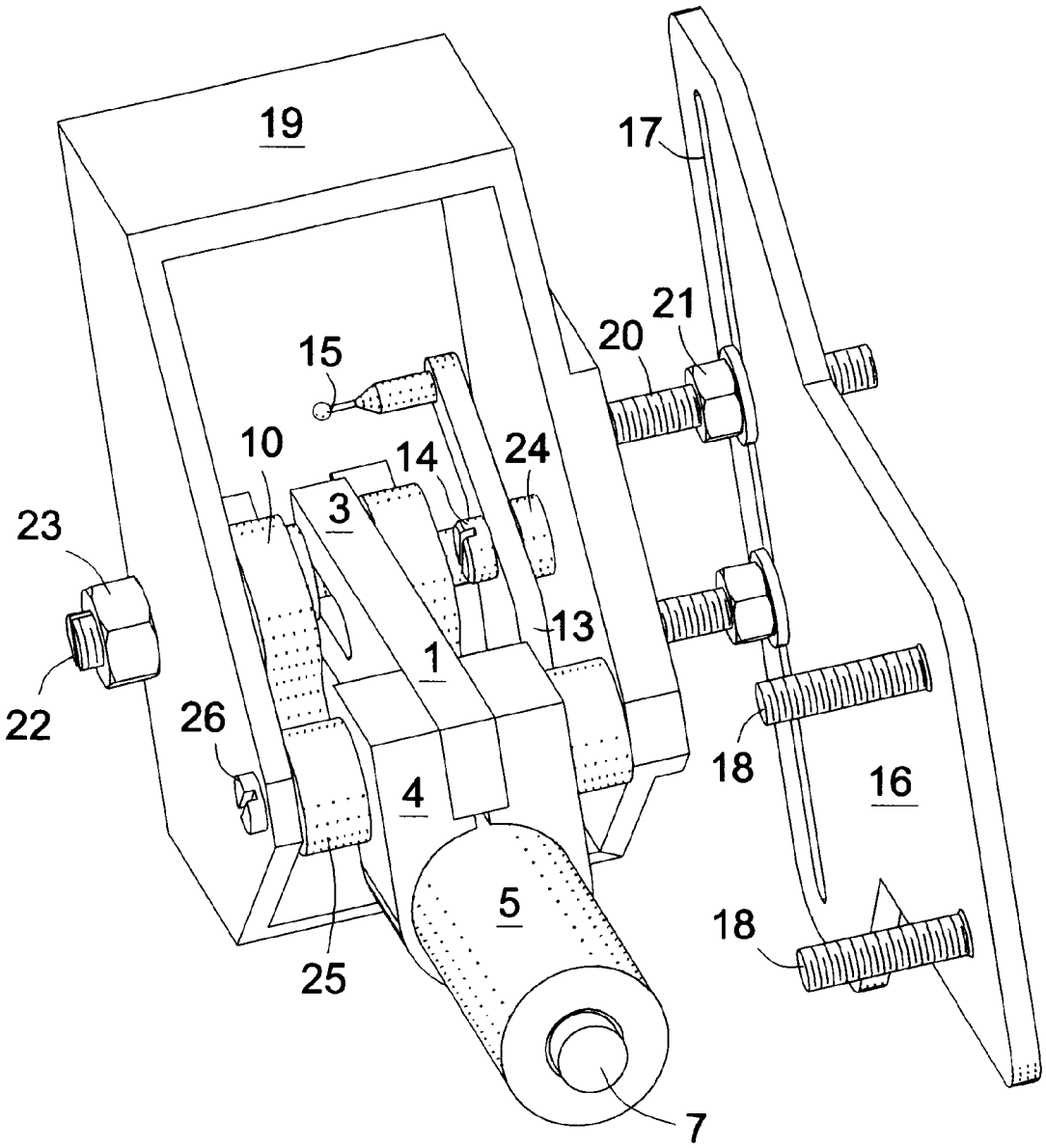
FIG. 2 is a back perspective view of the laser sight aimed 30 degrees below horizontal.
Figure 3:
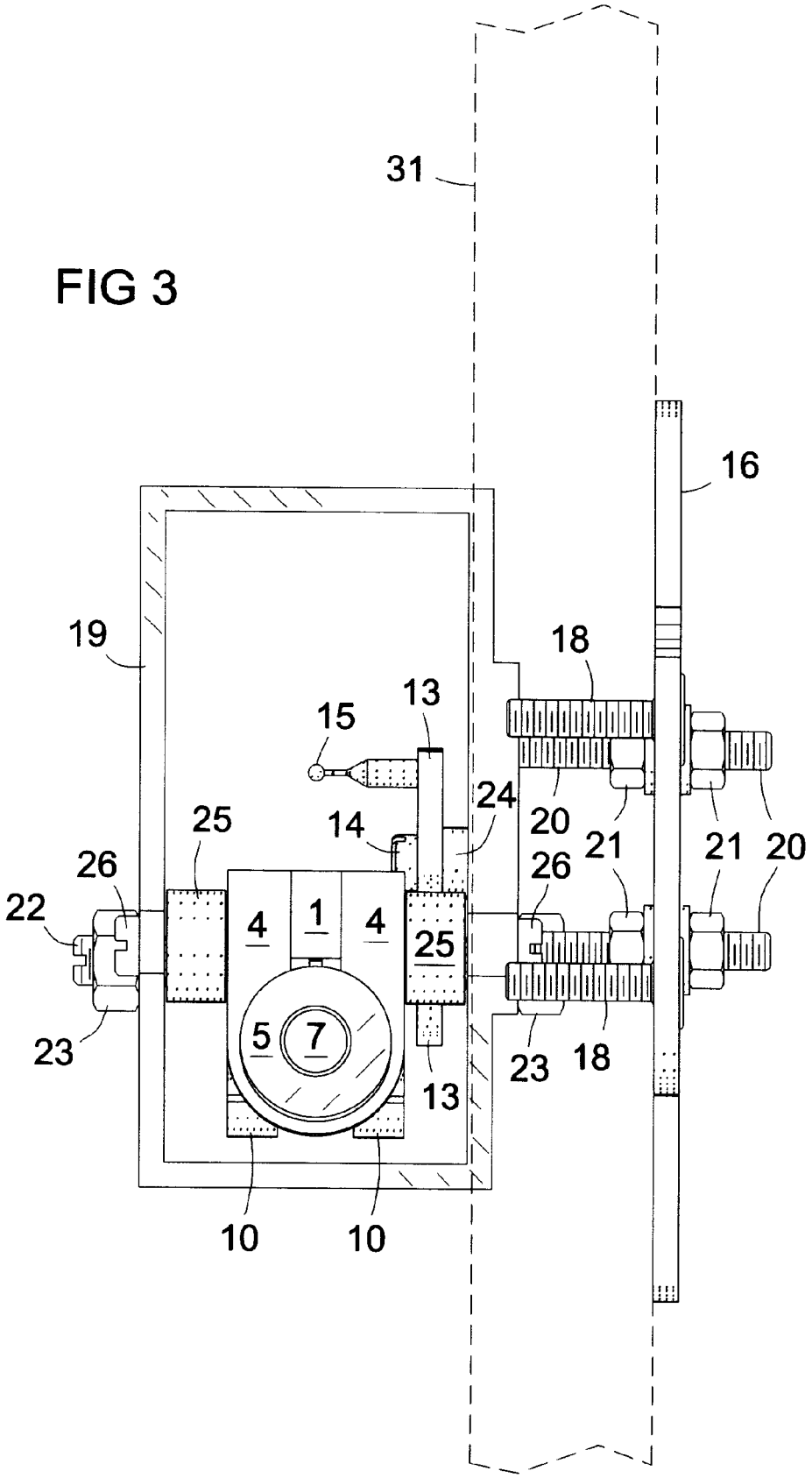
FIG. 3 is a back view of the laser sight from the archer's viewpoint when aimed 30 degrees below horizontal.

1. Laser pendulum follower bar
2. Laser pendulum follower bar pivot pin
3. Laser pendulum follower fork
4. Laser clamp
5. Laser body
6. Laser battery
7. Laser on/off switch
8. Laser generator
9. Laser aiming screws
10. Laser pendulum
11. Laser pendulum pivot pin
12. Laser pendulum offset shaft or cam
13. Peep pendulum
14. Peep pendulum pivot bolt
15. Peep sight pin
16. Mounting plate
17. Vertical adjustment slot in mounting plate
18. Machine screws for attaching mounting plate to bow
19. Sight box
20. Threaded sight box mounting shafts
21. Lateral adjustment nuts
22. Laser pendulum attachment screw

23. Laser pendulum attachment screw lock nut
24. Spacer washer for peep pendulum
25. Spacer washer for laser pivot shaft
26. Laser pivot shaft screw
27. Laser lens
28. Peep pin arm
29. Conventional drawstring peep hole
30. Bow
31. Bow handle
32. Arrow
33. Bowstring
34. Archer's line of sight from peep sight on bowstring through peep sight pin
35. Laser beam
36. Arrow trajectory
38. Eye of archer

TERMINOLOGY

"Left", "right", "front", and "back" are from an archer's viewpoint. The front of the sight is toward the target. The right side of the sight is to the archer's right.

DESCRIPTION OF THE PREFERRED EMBODIMENTS

FIG. 1 shows a perspective front view of a sight box 19 having open front and back ends. A pendulum 10 depends from pivot pins 11 on screws 22 attached to the left and right sides of the box and fixed by lock-nuts 23. The pendulum 10 comprises two masses connected by a shaft 12. The shaft 12 is offset from the pendulum pivot axis, to act as a cam. A cam follower bar 1 is pivotally mounted to the sides of the sight box at the back end of the box. The front end of the follower bar is forked 3 to bracket the offset shaft 12. The follower fork cannot be displaced from the cam in any direction by jolts or rapid movement, and is constrained to follow the cam accurately.

Figure 4:
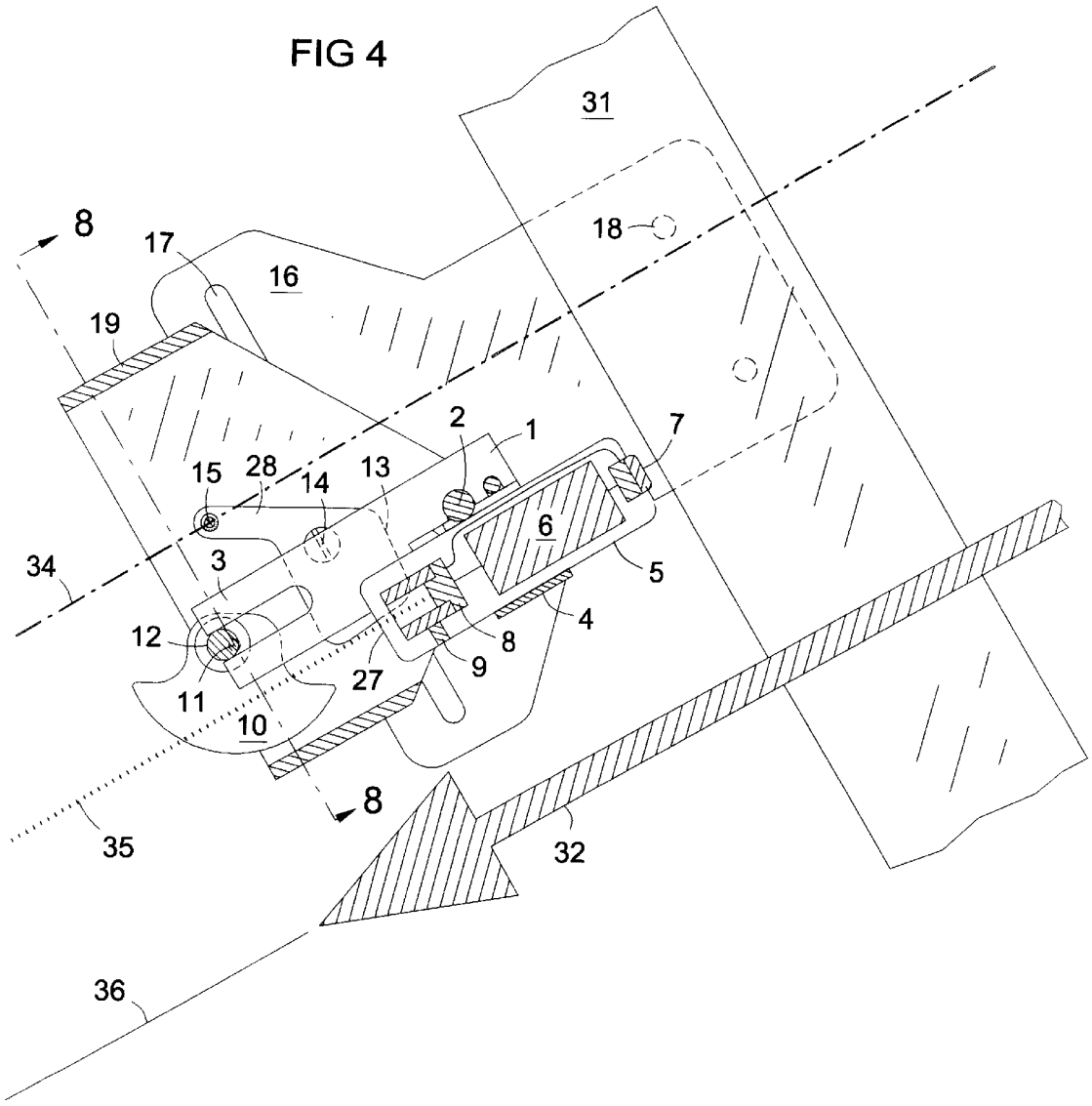
FIG. 4 is a side sectional view of the laser sight held 30 degrees below horizontal.
Figure 5:
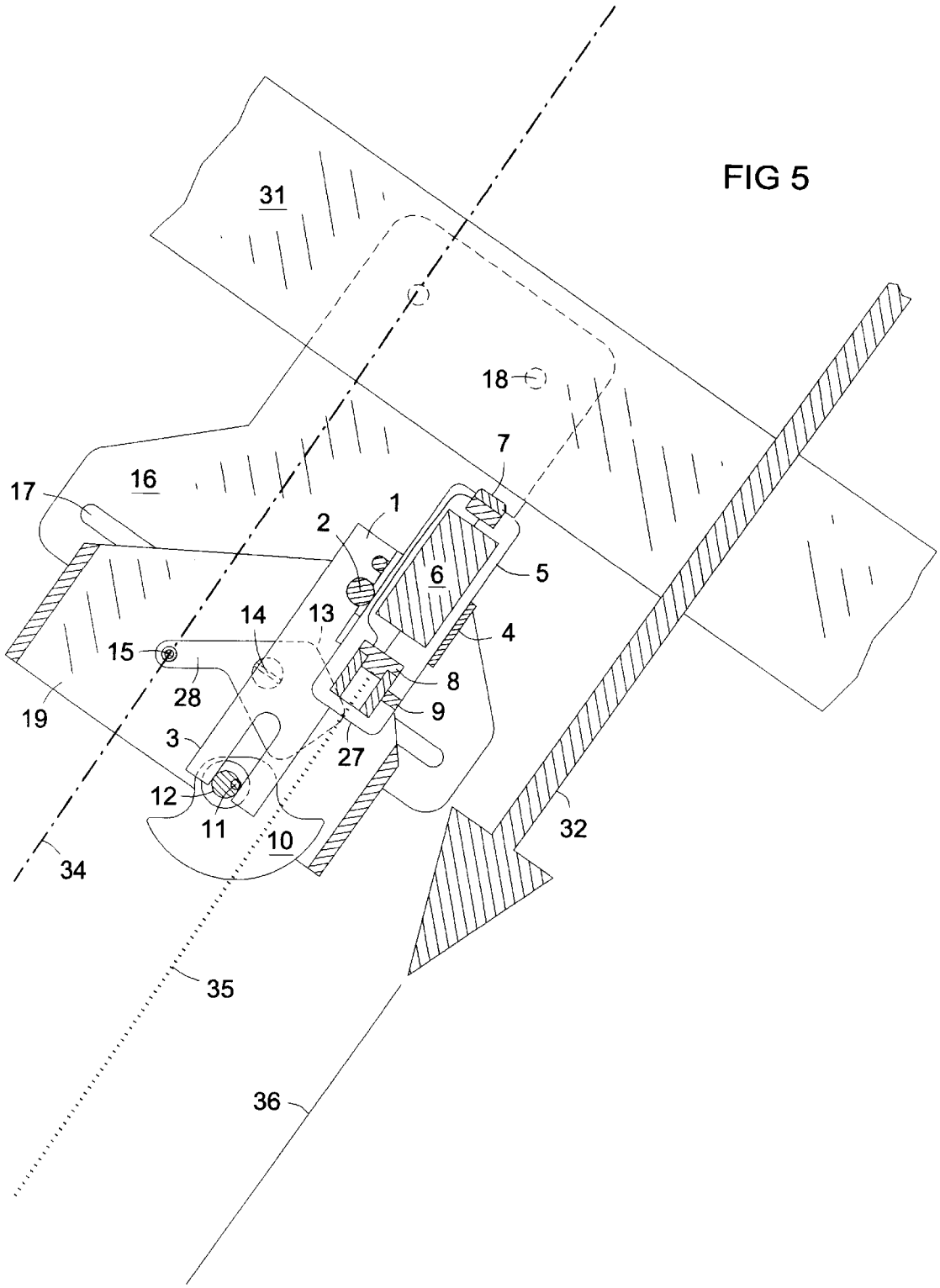
FIG. 5 is a side sectional view of the laser sight held 60 degrees below horizontal.
Figure 6:
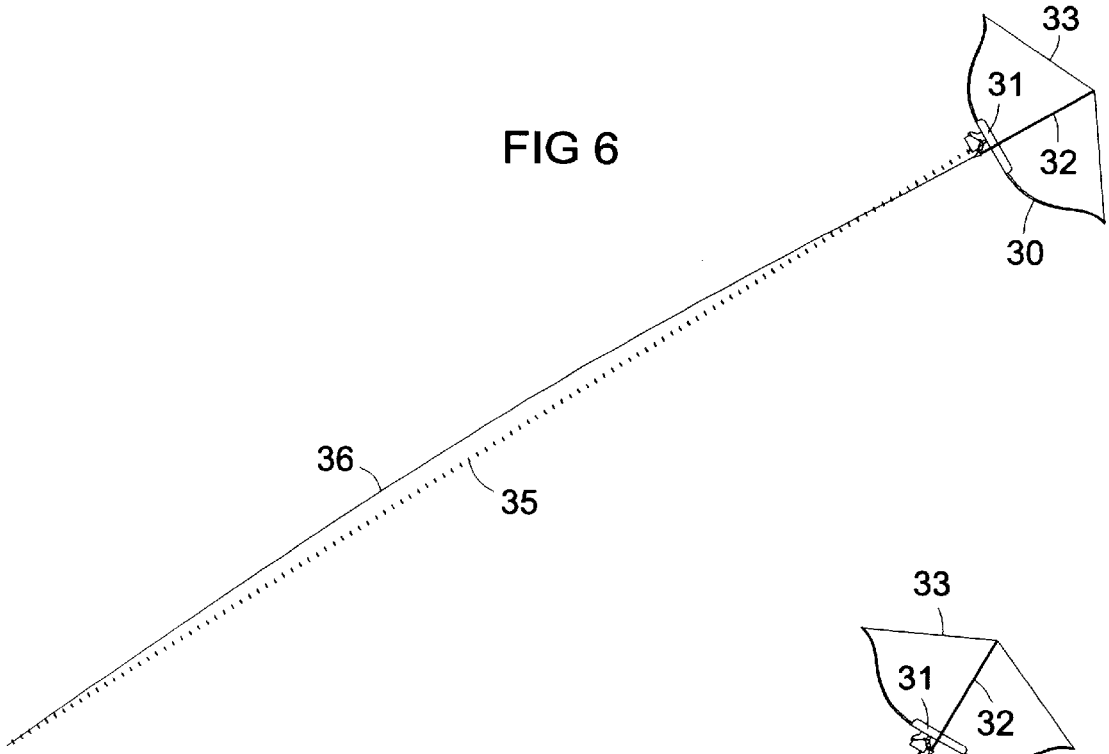
FIG. 6 is a side view of the arrow trajectory aimed 30 degrees below horizontal as in FIGS. 1–4.
Figure 7:
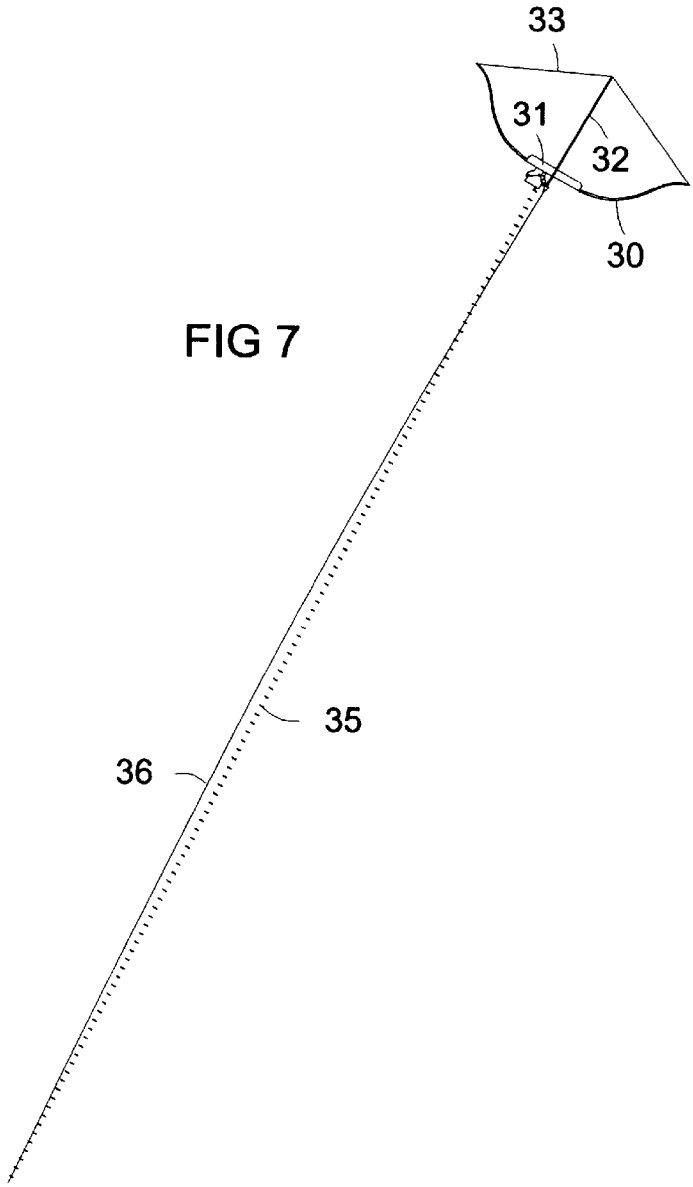
FIG. 7 is a side view of the arrow trajectory aimed 60 degrees below horizontal as in FIG. 5.
Figure 8:
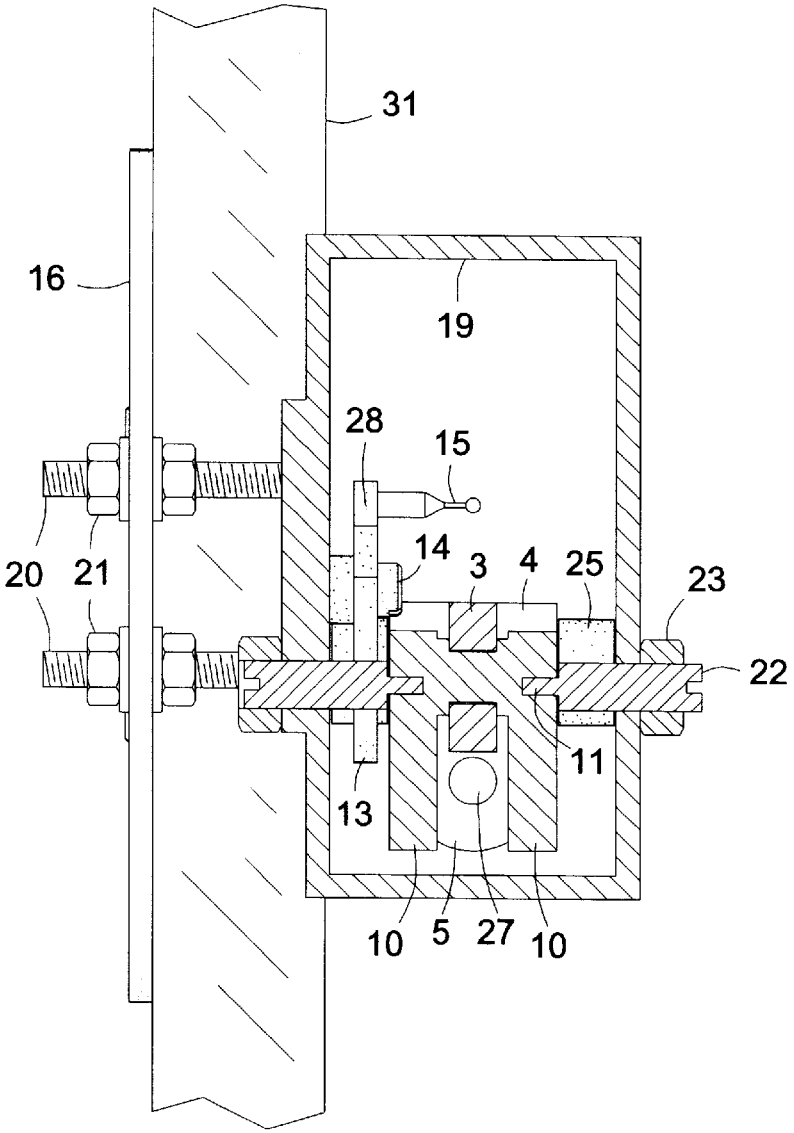
FIG. 8 is a front sectional view along section line 9 of FIG. 4.

FIG. 4 shows a side sectional view of the sight mechanisms when the bow is aimed 30 degrees downward from horizontal. A conventional self-contained laser pointer designed for bow sights is mounted on the follower bar via a clamp 4. The laser pointer comprises a cylindrical case 5 with a laser generator 8 in the front, an internal battery 6, and an on/off switch 7 in the back. It has two screws 9 for adjusting the beam direction vertically and horizontally. The laser beam 35 exits the front of the case via a lens 27, and passes between the two masses of the laser pendulum 10.

Figure 9:
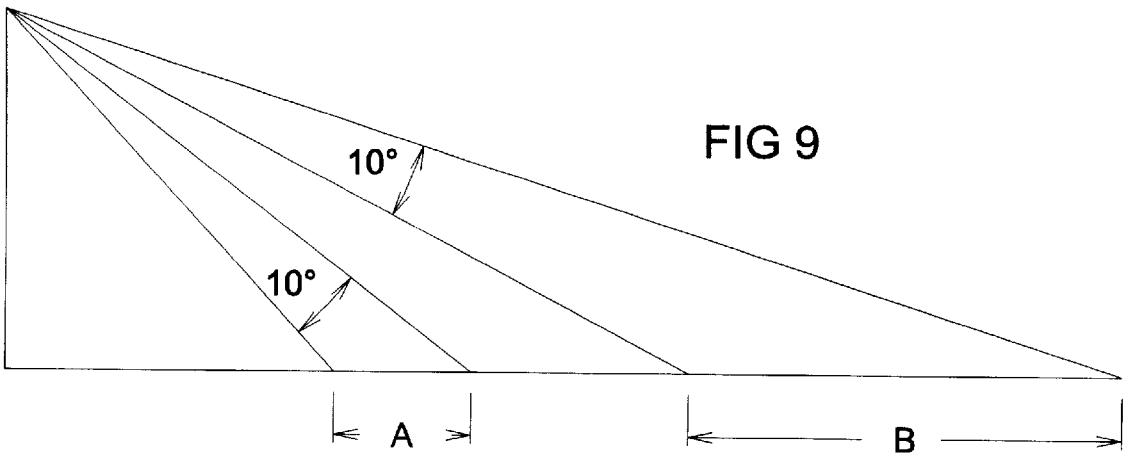
FIG. 9 shows the changing relationship of distance to bow angle, which requires faster compensation by the cam as the bow is raised toward horizontal.
Figure 10:
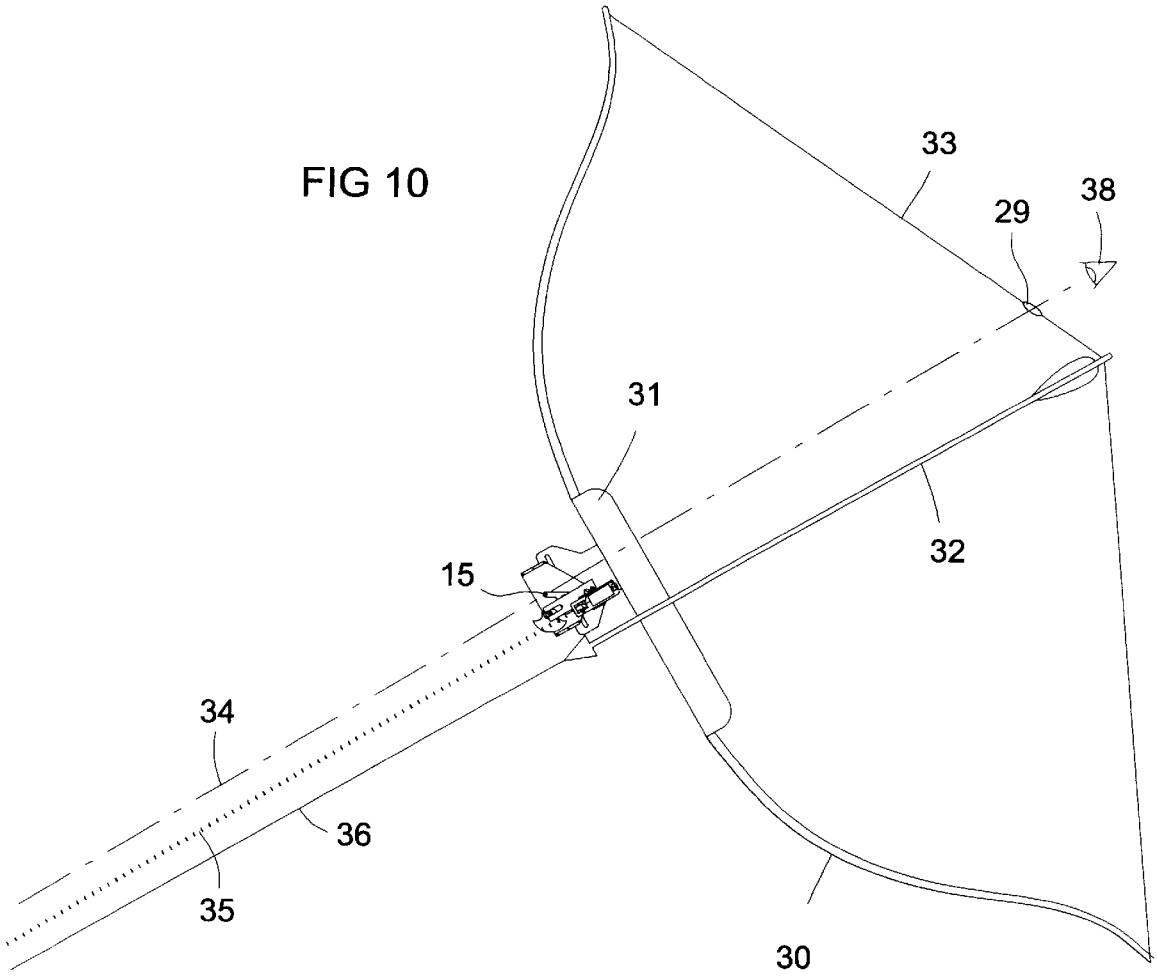
FIG. 10 is a side view of the bow aimed 30 degrees below horizontal with the sight in section, showing the line of sight through the peep pin.

The cam 12 is offset from the laser pendulum pivot axis 11 in a forward direction. This provides the desired compensation. As the bow is raised toward a horizontal aim, the cam lowers the laser beam relative to the bow to compensate for the greater drop of the arrow over longer distances. As the aim is lowered from horizontal, the cam raises the laser beam relative to the bow to adjust for straighter trajectories resulting from shorter distances and a smaller gravitational effect. The cam is designed to provide a greater rate of compensation as the aim approaches horizontal, and a lower compensation rate as the aim approaches straight down. This is because the target distance changes more rapidly with bow angle as the bow is raised toward horizontal, as shown in FIG. 9, where clearly distance B is much greater than distance A even though the angular change is the same. Also, as the trajectory approaches horizontal, the gravity vector is more perpendicular to the trajectory, resulting in a higher curvature.

A peep pin 15 is provided for use in conjunction with a conventional peep sight on the bowstring, such that the line of sight from archer's eye through the bowstring peep sight and peep pin will meet the laser spot closely enough for quick visual acquisition of the laser spot. This allows the archer to quickly move the laser spot to the target without delay in locating the spot on the landscape. The peep pin 15 is continuously compensated by a second pendulum 13 to follow the compensated laser beam. The second pendulum 13 is pivotally mounted to the right side of the sight box, with the peep pin held forward on an arm 28. This causes the pin to rise relative to the sight box as the bow angle is lowered, thus raising the sight line 34 to follow the laser spot. The length of the peep pin arm 28 is based on the draw length and position of the peep hole 29 on the bowstring. A conventional bowstring peep hole is about 13 cm (5 in.) above the center of the drawstring, and about 10 cm (4 in.) above the arrow when drawn. In this case, the peep pin should be less than 10 cm (4 in.) above the arrow for all bow angles but should approach 10 cm (4 in.) above the arrow as the bow angle approaches straight down.

A mounting plate 16 serves to attach the sight to the bow handle. Two machine screws 18 are threaded into conventional sight-mounting taps on the right side of the bow handle. The sight box 19 has two threaded shafts 20 extending from the right side. These shafts pass through a vertical adjustment slot 17 in the mounting plate. A pair of nuts 21 on each shaft 20 bracket the plate. This provides both vertical and lateral adjustment of the sight box relative to the mounting plate. The line of sight through the peep pin is adjusted by moving the sight box vertically and laterally as next described.

To adjust the bow sight, the archer/hunter stands on a tree platform at an average height, such as 6 meters, and shoots an arrow at a target at an average distance and downward angle, such as 12 meters from the base of the tree on level ground. The peep sight is used for this shot. The sight box 19 is adjusted in the direction of any errors in the shot. For example, if the shot is low, the sight box is moved downward. To adjust the sight box, it is moved vertically in the vertical adjustment slot 17, and/or laterally using the adjustment nuts 21. This process is repeated until the peep sight is adjusted satisfactorily. Then the laser adjustment screws 9 are used to move the laser spot laterally and vertically to the same point on the target seen through the peep sight. The peep sight and laser sight are now coordinated, and will compensate automatically for other angles.

Although the present invention has been described herein with respect to preferred embodiments, it will be understood that the foregoing description is intended to be illustrative, not restrictive. Modifications of the present invention will occur to those skilled in the art. All such modifications which fall within the scope of the appended claims are intended to be within the scope and spirit of the present invention.

I claim:

1. A laser sight for hunting bows, comprising:

a sight box having left and right sides, and having open front and back ends;

a first pendulum pivotally attached to the sight box, having a center of mass and a pivot axis;

a cam on the first pendulum, having a surface eccentric to the first pendulum pivot axis;

a cam follower pivotally attached to the sight box, having an end in contact with cam;

a laser beam generator attached to the cam follower;

a second pendulum pivotally attached to the sight box;

a sight pin on the second pendulum.

2. The laser sight of claim 1, further comprising:

a sight mounting plate with a vertically elongated slot;

at least one sight mounting shaft attached to the right side of the sight box and passing through the vertically elongated slot in the mounting plate;

first and second nuts threaded on the sight mounting shaft, bracketing the sight mounting plate for attachment of the sight box to the sight mounting plate;

whereby the sight box can be adjusted vertically and laterally on the mounting plate.

3. The laser sight of claim 1, wherein the first pendulum is pivotally attached to the left and right sides of the sight box at the front end of the sight box; the cam is a shaft on the first pendulum having an axis offset from the first pendulum pivot axis; the cam follower is a bar pivotally attached to the left and right sides of the sight box at the back end of the sight box, the follower bar having a forked front end bracketing the cam; and the laser beam generator comprises a case having a front end with a laser diode, two adjustment screws for adjusting the laser beam vertically and horizontally, and a back end with battery and a switch.

4. A laser sight for hunting bows, comprising:

a sight box having left and right sides, and having open front and back ends;

a laser pendulum pivotally attached to the sight box, the laser pendulum having a center of mass and a laterally oriented pivot axis;

a cam on the laser pendulum in the form of an offset shaft having an axis parallel to the laser pendulum pivot axis and offset from it in a generally forward direction;

a laser pendulum follower bar pivotally attached to the sight box, having an end that contacts the offset shaft;

a laser beam generator attached to the follower;

a peep pendulum pivotally attached to the sight box;

a sight pin on the peep pendulum.

5. The laser sight of claim 4, further comprising:

a sight mounting plate with a vertically elongated slot;

at least one sight mounting shaft attached to the right side of the sight box and passing through the vertically elongated slot in the mounting plate;

first and second nuts threaded on the sight mounting shaft, bracketing the sight mounting plate for attachment of the sight box to the sight mounting plate;

whereby the sight box can be adjusted vertically and laterally on the mounting plate.

6. The laser sight of claim 4, wherein the laser pendulum comprises two masses connected by the offset shaft; the laser pendulum is pivotally attached to the left and right sides of the sight box at the front end of the sight box; the laser pendulum follower bar is pivotally attached to the left and right sides of the sight box at the back end of the sight box; and the follower bar has a front end in the form of a fork that brackets the offset shaft.

7. The laser sight of claim 4, wherein the laser beam generator comprises a case, a laser diode, a battery, a switch, a horizontal adjustment screw, and a vertical adjustment screw, the adjustment screws acting between the case and the diode to control the direction of the laser beam relative to the case.

* * * * *